US007054750B2

(12) United States Patent
Rodney et al.

(10) Patent No.: US 7,054,750 B2
(45) Date of Patent: May 30, 2006

(54) METHOD AND SYSTEM TO MODEL, MEASURE, RECALIBRATE, AND OPTIMIZE CONTROL OF THE DRILLING OF A BOREHOLE

(75) Inventors: Paul F. Rodney, Spring, TX (US); Ronald L. Spross, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 77 days.

(21) Appl. No.: 10/793,350

(22) Filed: Mar. 4, 2004

(65) Prior Publication Data

US 2005/0197777 A1 Sep. 8, 2005

(51) Int. Cl.
*G01V 3/18* (2006.01)

(52) U.S. Cl. ..... 702/9

(58) Field of Classification Search ..... 702/9, 702/6, 7; 175/45; 703/10
See application file for complete search history.

(56) References Cited

U.S. PATENT DOCUMENTS

| | | | | |
|---|---|---|---|---|
| 4,407,017 A | | 9/1983 | Zhilikov et al. | 364/420 |
| 4,794,534 A | | 12/1988 | Millheim | 364/420 |
| 5,191,326 A | | 3/1993 | Montgomery et al. | 340/855.5 |
| 5,419,405 A | | 5/1995 | Patton | 175/27 |
| 5,439,064 A | | 8/1995 | Patton | 175/24 |
| 5,678,643 A | * | 10/1997 | Robbins et al. | 175/45 |
| 5,812,068 A | | 9/1998 | Wisler et al. | 340/855.5 |
| 5,842,149 A | | 11/1998 | Harrell et al. | 702/9 |
| 5,896,939 A | | 4/1999 | Witte | 175/40 |
| 6,021,377 A | | 2/2000 | Dubinsky et al. | 702/9 |
| 6,073,079 A | | 6/2000 | Thomas | 702/9 |
| 6,088,294 A | | 7/2000 | Leggett, III et al. | 367/25 |
| 6,109,368 A | | 8/2000 | Goldman et al. | 175/39 |
| 6,179,067 B1 | | 1/2001 | Brooks | 175/45 |
| 6,233,524 B1 | | 5/2001 | Harrell et al. | 702/9 |
| 6,244,375 B1 | | 6/2001 | Norris et al. | 181/102 |
| 6,272,434 B1 | | 8/2001 | Wisler et al. | 702/9 |
| 6,302,204 B1 | | 10/2001 | Reimers et al. | 166/250.03 |
| 6,310,559 B1 | | 10/2001 | Laborde et al. | 340/853.2 |
| 6,347,282 B1 | * | 2/2002 | Estes et al. | 702/6 |
| 6,408,953 B1 | | 6/2002 | Goldman et al. | 175/39 |
| 6,434,084 B1 | | 8/2002 | Schultz | 367/81 |
| 6,438,495 B1 | * | 8/2002 | Chau et al. | 702/9 |
| 6,516,898 B1 | * | 2/2003 | Krueger | 175/50 |
| 6,529,834 B1 | | 3/2003 | Estes et al. | 702/9 |
| 6,549,854 B1 | * | 4/2003 | Malinverno et al. | 702/16 |
| 6,601,658 B1 | | 8/2003 | Downton | 175/45 |

(Continued)

OTHER PUBLICATIONS

*Tortuosity versus Micro-Tortuosity—Why Little Things Mean a Lot*, Tom M. Gaynor, et al., Sperry-Sun Drilling Services, a Halliburton Company, SPE/IADC 67818, SPE/IADC Drilling Conference, Amsterdam, The Netherlands, Feb. 27, 2001-Mar. 1, 2001.

(Continued)

*Primary Examiner*—Donald McElheny, Jr.
(74) *Attorney, Agent, or Firm*—Baker Botts L.L.P.

(57) ABSTRACT

Methods and systems for controlling the drilling of a borehole are disclosed. The methods employ the assumption that nonlinear problems can be modeled using linear equations for a local region. Common filters can be used to determine the coefficients for the linear equation. Results from the calculations can be used to modify the drilling path for the borehole. Although the calculation/modification process can be done continuously, it is better to perform the process at discrete intervals along the borehole in order to maximize drilling efficiency.

27 Claims, 9 Drawing Sheets

U.S. PATENT DOCUMENTS

| | | | | |
|---|---|---|---|---|
| 6,609,067 | B1 | 8/2003 | Tare et al. | 702/9 |
| 6,662,110 | B1 | 12/2003 | Bargach et al. | 702/6 |
| 2002/0010548 | A1 | 1/2002 | Tare et al. | 702/9 |
| 2002/0120401 | A1 | 8/2002 | Macdonald et al. | 702/6 |
| 2002/0177955 | A1 | 11/2002 | Jalali et al. | |
| 2003/0014190 | A1 | 1/2003 | Dubinsky et al. | 702/7 |
| 2003/0080743 | A1 | 5/2003 | Das et al. | 324/338 |
| 2003/0168257 | A1 | 9/2003 | Aldred et al. | 175/24 |
| 2003/0212495 | A1 | 11/2003 | Mese et al. | 702/9 |
| 2003/0236627 | A1 | 12/2003 | Estes | 702/9 |
| 2005/0024231 | A1 | 2/2005 | Fincher | |
| 2005/0194132 | A1 | 9/2005 | Dudley et al. | |
| 2005/0194182 | A1 | 9/2005 | Rodney et al. | |
| 2005/0194183 | A1 | 9/2005 | Gleitman et al. | |
| 2005/0194184 | A1 | 9/2005 | Gleitman | |
| 2005/0194185 | A1 | 9/2005 | Gleitman | |
| 2005/0200498 | A1 | 9/2005 | Gleitman | |

OTHER PUBLICATIONS

*Anaconda drilling system nears commercial rollout, Drilling Contractor*, John Kennedy, Contributing Editor, pp. 36-37, Jul./Aug. 2000.

U.S. Appl. No. 60/491,567, filed Jul. 31, 2003, Fincher.

U.S. Appl. No. 60/478,237, filed Jun. 13, 2003, Fincher.

International Search Report (PCT/US04/06284).

* cited by examiner

METHOD AND SYSTEM TO MODEL, MEASURE, RECALIBRATE, AND OPTIMIZE CONTROL OF THE DRILLING OF A BOREHOLE

BACKGROUND

The present invention relates to the field of borehole drilling for the production of hydrocarbons from subsurface formations. In particular, the present invention relates to systems that modify the drilling process based upon information gathered during the drilling process.

As oil well drilling becomes more and more complex, the importance of maintaining control over as much of the drilling equipment as possible increases in importance.

There is, therefore, a need in the art to infer the actual borehole trajectory from the measurements made by existing systems. There is also a need in the art to project the borehole trajectory beyond the greatest measured depth as a function of the control parameters.

BRIEF DESCRIPTION OF THE DRAWINGS

A more complete understanding of the present disclosure and advantages thereof may be acquired by referring to the following description taken in conjunction with the accompanying drawings, wherein.

Figure 1A:
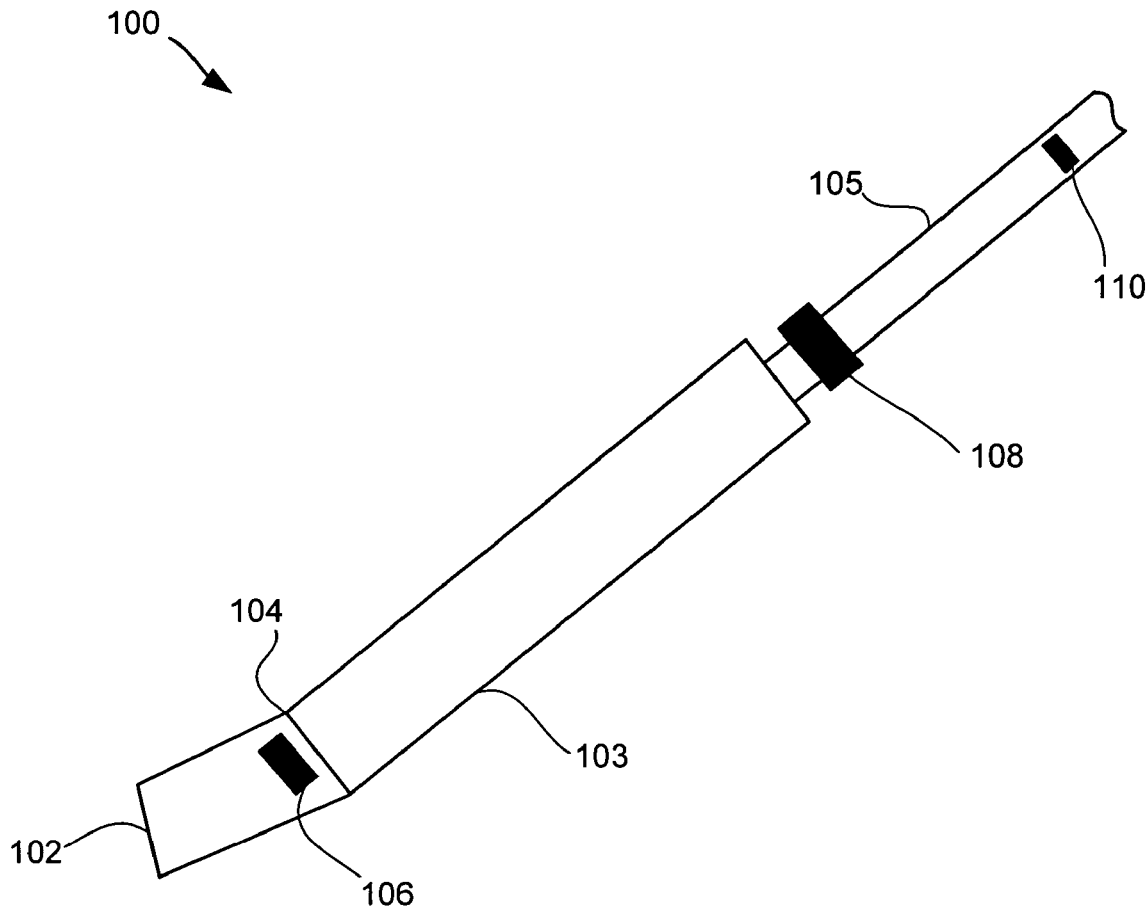
FIG. 1*a* is a diagram of a bottom hole assembly according to the teachings of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

The description that follows is better understood in conjunction with the following terms:

( ) after a matrix over variables encloses the index of a sample number corresponding to that specific state or matrix.

$\alpha$ is a weighting factor used in the symmetrical, exponential filter of equations (9) and (10).

A is a matrix in the state vector formulation which governs the underlying physics.

$b_x$ is the near magnetometer x-axis bias, which includes magnetic interference.

$b_y$ is the near magnetometer y-axis bias, which includes magnetic interference.

$b_z$ is the near magnetometer z-axis bias, which includes magnetic interference.

B is a matrix in the state vector formulation which governs the relation between the control variables and the state of the system.

c is the number of control parameters.

C is a matrix in the state vector formulation which governs the relation between the observables, y and the state of the system, x.

$\tilde{C}$ is an augmented version of C which makes it possible to include sensor bias without significantly reformulating the problem (refer to equation ($\tilde{2}$) and the discussion around it).

$C_F$ is a sub matrix of matrix C containing those matrix elements pertaining to the far inclinometers/magnetometers ("inc/mag") package.

$\tilde{C}_N$ is a sub matrix of matrix $\tilde{C}$ containing those matrix elements pertaining to the near inc/mag package.

D is a matrix in the state vector formulation which governs the relation between the system noise, w and the state vector, x. For simplicity, D has been set to the identity matrix.

E( ) is used to denote "expected value of".

F as a subscript refers to the far inclinometer/magnetometer package.

$H(\Omega,\alpha,\xi)$ is a spatial frequency domain transfer function for the symmetrical exponential filter of equations (9) and (10). The spatial frequency $\Omega$ is expressed in terms of the spatial sampling frequency.

i is an arbitrary sample index.

I as a subscript refers to an inclinometer package.

$I_{kxk}$ is the kxk identity matrix.

K is the Kalman gain, defined recursively through equations (15)–(17) (see below).

m is an arbitrary sample index.

M is an integer offset used in the resampling. The resampling is carried out such that the far sensor lags the near sensor by M samples.

M as a subscript refers to a magnetometer package.

n is an index used to designate the latest available sample.

N as a subscript refers to the near inclinometer/magnetometer package.

P is a variable in the Kalman predictor equations defined recursively via equations (16) and (17) (see below).

$R_v$ is the cross-correlation matrix for noise process v.

$R_w$ is the cross-correlation matrix for noise process w.

$\xi$ is the number of samples on either side of the central sample in the symmetrical exponential filter of equations (9) and (10) (see below).

$s_x$ is the near magnetometer x-axis scale factor.

$s_y$ is the near magnetometer y-axis scale factor.

$s_z$ is the near magnetometer z-axis scale factor (the z-axis is conventionally taken as the tool axis).

w is a vector representing the system noise. In general, the dimensionality of w may be different from that of x, but due to our ignorance of the system, it has been set to that of x.

x x(i) denotes the state vector corresponding to the $i^{th}$ sample of the system. For a given sample, x had 6 components in the initial formulation of the problem. These six components corresponded to the outputs an ideal inclinometer/magnetometer package would have were it to follow the borehole trajectory in space. With the remapping discussed on pages 6 and 7, x has 12 elements for a given sample. A specific tool face angle must be assumed in specifying x.

$\tilde{x}$ is an augmented version of the 6 component state vector x which makes it possible to include sensor bias without significantly reformulating the problem (refer to equation (2) and the discussion around it). $\tilde{x}$ has 7 elements instead of 6; the extra element is set to 1.

$\check{x}$ is a filtered version of x , discussed more fully on page 5 in relation to equations (9) and (10) (see below).

$\hat{x}$ is the Kalman predictor of the state vector x. Note that in the renumbering of the near and far variables so as to bring them to a common point in space, this vector has 12 elements at each sample.

y is the vector corresponding to the measurements. y has 12 components. The first six components come from the near inc/mag package; the second six components come from the far inc/mag package.

$y_N$ consists of the near elements of y, i.e., the first six elements of y.

$y_F$ consists of the far elements of y, i.e., the last six elements of y.

$\tilde{y}_F$ is an augmented version of the vector $y_F$ (refer to equation (6) and the discussion around it).

To obtain hydrocarbons such as oil and gas, boreholes are drilled by rotating a drill bit that is attached to the end of the drill string. A large proportion of drilling activity involves directional drilling, i.e., drilling deviated and/or horizontal boreholes, in order to increase the hydrocarbon production from underground formations. Modern directional drilling systems generally employ a drill string having a bottom hole assembly ("BHA") and a drill bit at end thereof that is rotated by a drill motor (mud motor) and/or the drill string. A number of downhole devices placed in close proximity to the drill bit measure certain downhole operating parameters associated with the drill string. Such devices typically include sensors for measuring downhole temperature and pressure, azimuth and inclination measuring devices and a resistivity-measuring device to determine the presence of hydrocarbons and water. Additional downhole instruments, known as logging-while-drilling ("LWD") tools, are frequently attached to the drill string to determine the formation geology and formation fluid conditions during the drilling operations.

Pressurized drilling fluid (commonly known as the "mud" or "drilling mud") is pumped into the drill pipe to rotate the drill motor and to provide lubrication to various members of the drill string including the drill bit. The drill pipe is rotated by a prime mover, such as a motor, to facilitate directional drilling and to drill vertical boreholes. The drill bit is typically coupled to a bearing assembly having a drive shaft that in turn rotates the drill bit attached thereto. Radial and axial bearings in the bearing assembly provide support to the radial and axial forces of the drill bit.

Boreholes are usually drilled along predetermined paths and the drilling of a typical borehole proceeds through various formations. The drilling operator typically controls the surface-controlled drilling parameters, such as the weight on bit, drilling fluid flow through the drill pipe, the drill string rotational speed (r.p.m. of the surface motor coupled to the drill pipe) and the density and viscosity of the drilling fluid to optimize the drilling operations. The downhole operating conditions continually change and the operator must react to such changes and adjust the surface-controlled parameters to optimize the drilling operations. For drilling a borehole in a virgin region, the operator typically has seismic survey plots which provide a macro picture of the subsurface formations and a pre-planned borehole path. For drilling multiple boreholes in the same formation, the operator also has information about the previously drilled boreholes in the same formation. Additionally, various downhole sensors and associated electronic circuitry deployed in the BHA continually provide information to the operator about certain downhole operating conditions, condition of various elements of the drill string and information about the formation through which the borehole is being drilled.

Halliburton Energy Services of Houston, Tex. has developed a system, called "ANACONDA™" to aid in the drilling of boreholes. ANACONDA is a trademark of Halliburton Energy Services of Houston, Tex. The ANACONDA™ system has two sets of sensor packages, one for inclination and one for magnetic called the inclinometers and the magnetometers ("inc/mag"). One set of sensor packages is fitted close to the bend in the tool, and thus close to magnetic interference, the second package is placed farther up hole, far from the bend and thus far from magnetic interference.

There are three control points in the ANACONDA™ system:

a. The bend, which can be controlled in two dimensions;

b A first packer, which can be inflated or not; and c. A second packer, which operates the same or similarly to the first packer and which may be separated by a variable distance from the first package.

Given a system such as this, it will now be shown that the information which is sought can be viewed as solutions for a state vector. The general equations for a linear state variable are given by described in "Signal Processing Systems, Theory and Design," N. Kalouptsidis, A Wiley-Interscience Publication, John Wiley & Sons, Inc., New York, 1997 as:

$$x(n+1)=A(n)\cdot x(n)+B(n)\cdot u(n)+D(n)\cdot w(n) \quad (1)$$

$$y(n)=C(n)\cdot x(n)+v(n) \quad (2)$$

Where:

The vectors x(i) represent successive states of the system. These states are, in general, not known, but inferred.

The vectors u(i) represent the measurable input signal, assumed to be deterministic. The u(i) represent the controls to the system.

The vectors y(i) represent the output of the system (a measurable vector)

w(n) represents the process noise v(n) represents the measurement noise

The matrices A, B, C and D are determined by the underlying physics and mechanisms employed in the drilling process. Equation (1) perfectly reflects the problem at hand if we take the vector x(n) to be the set of 6 measurements an ideal survey sensor would make in surveying the borehole at sample point n. The vector u(n) would be the vector of control variables applied at survey point n, namely the two bend angles of the BHA, the depth, the inflation of each of the packers, and the separation of the packers (and any other control variables). Finally, the vector y(n) would be the set of 12 measurements from the near and far inc/mag packages.

The true borehole trajectory, if it were known, could be described by a set of inclination and azimuth values versus depth. Alternatively, the borehole trajectory could be described in terms of the outputs from an ideal, noiseless inc/mag package at each of the measured depths (as a detail, it would be necessary to specify the tool face for such a package). Each set of measurements, at each depth, constitutes a state vector (six measurements at each depth, three from the inclinometers, three from the magnetometers). It is anticipated that, at least locally, the response of the system as formulated will be linear when the borehole is expressed in terms of a succession of these state vectors. The state vectors themselves can be obtained via a series of matrix transformations which are nonlinear functions of the inclination, azimuth and tool face. It is this nonlinearity which makes it desirable to express the state vectors in terms of an ideal sensor rather than the true angular coordinates.

There are several difficulties with directly carrying forward a solution of the problem as formulated. While it should be possible to formulate the matrices A, B, C, and D using drill string mechanics, this is an extremely difficult problem. It appears most practical to estimate these matrices based on experience, but the vectors x(n) are never known. This is actually the core of the problem; means must be devised to operate as though the x(n) are known.

In addition, the noise processes are not known, although reasonable guesses can be made for these processes, and these guesses can be modified based on experience.

Furthermore, in the body of available literature dealing with such systems, it is always assumed that the noise sources have zero mean. This is a very poor assumption for the problem at hand in which the magnetometers near the bit are likely to experience magnetic interference. All needed theorems can be reworked in terms of noise sources with non-zero mean, but the resulting equations are often extremely cumbrous. Many of the prior art systems use a "continuous measure/continuous-update procedure. Unfortunately, continuous correction often leads to excessive levels of micro-tortuosity, which results in increased annoyingly drag on the dill bit and erratic boreholes.

Drilling programs are often conducted in accordance with a pre-drilling model of the subterranean conditions and the intended path of the borehole or other borehole parameters. Models which may be used include the Drillstring Whirl Model, Torque/Drag/Buckling Model, BHA Dynamics Model, Geosteering Model, Hydraulics Model, Geomechanics (rock strength) Model, pore pressure/fracture gradient ("PP/FG") Model, and the SFIP Model. Current methods do not provide a means to readily update the model based on downhole conditions sensed while drilling. In this new method, measured borehole data, possibly including data newly available because of increased bandwidth, would be sent to the surface during drilling. The data would be processed at the surface to update or recalibrate the current model to which the drilling program is being conducted. The control for the drilling program would then be updated to reflect the updated model. In one method, the model and instructions for the drilling program would be stored in a downhole device. After revising the model at the surface, information to update the stored downhole model, likely a much smaller quantity of information than the raw measured borehole data, would be transmitted downhole, whereupon the drilling program would then be continued as determined based upon the new model.

Seismic analysis techniques are useful for obtaining a course description of subsurface structures. Downhole sensors are more precise, but have far more limited range than the seismic analysis techniques. Correlation between original estimates based upon seismic analysis and readings from downhole sensors enable more accurate drilling. The correlation can be made more effective if performed in an automated manner, typically by use of a digital computer. The computations for the correlation can take place on the surface, or downhole, or some combination thereof, depending upon the bandwidth available between the downhole components and the surface, and the operating environment downhole.

A drill string is instrumented with a plurality of survey sensors at a plurality of spacings along a drill string. Surveys are taken continuously during the survey process from each of the surveying stations. These surveys can be analyzed individually using techniques such as, for example, IFR or IIFR. In addition to providing an accurate survey of the borehole, it is desired to provide predictions of where the drilling assembly is headed. Note that the surveys from the survey sensors located at different positions along the drill string will not, in general, coincide with each other when they have been adjusted for the difference in measured depth between these sensors. This is due in part to sensor noise, in part to fluctuations in the earth's magnetic field (in the case where magnetic sensors are used—but gyroscopes can be used in place or, or in addition to magnetic sensors), but mostly due to drill string deflection. As is illustrated below, in a curved borehole, drill string deflection causes successive surveys to be different. This difference is related to the drill string stiffness, to the curvature of the borehole, and the forces acting on the drill string. As an alternative (but preferred) embodiment, torque, bending moment, and tension measurements are also made at a plurality of locations along the drill string, preferably located near the plurality of survey sensors. All of this information can then be coupled with a mechanical model (based on standard mechanics of deformable materials and on borehole mechanics) to predict the drilling tendency of the bit. Given all of the variables and uncertainties in the drilling process, it is believed that this problem is best approached from a signal processing standpoint.

Other disclosures discuss the improved downhole data available as a result of improved data bandwidth, e.g., the receipt and analysis of data from sensors spaced along the drill string (e.g., multiple pressure sensors) and the receipt and analysis of data from a point at or near the drill bit (e.g., cutter stress or force data). Such data may be used for real time control of drilling systems at the surface. For example, one could ascertain information about the material being drilled from analysis at the surface of information from bit sensors. Based on the data, one might chose to control in a particular manner the weight on bit or speed of bit rotation. One might also use such information to control downhole devices. For example, one might control from uphole, using such data, a downhole drilling device with actuators, e.g., a hole enlargement device, rotary steerable device, device with adjustable control nozzles, or an adjustable stabilizer. One might actively control downhole elements e.g., bite (adjusting bit nozzles), adjustable stabilizers, clutches, etc.

FIG. 1 illustrates the various components of the BHA. Referring specifically to FIG. 1*a*, the BHA 100 has a bit 102 that is connected at bend 104 to the motor element 103 which may or may not be operated during drilling, depending upon whether or not the borehole is to be bent. The BHA 100 is connected to the surface drilling rig via pipe 105. Various sensors 106, 108 and 110 can be attached to the BHA 100 as illustrated in FIG. 1*a*. In particular, sensors 108 and 110 are spaced a predetermined (or variable) distance apart. The separation distance between sensors 108 and 110 is necessary for measuring the attitude of the BHA 100 at various points along the borehole 120.

Figure 1B:
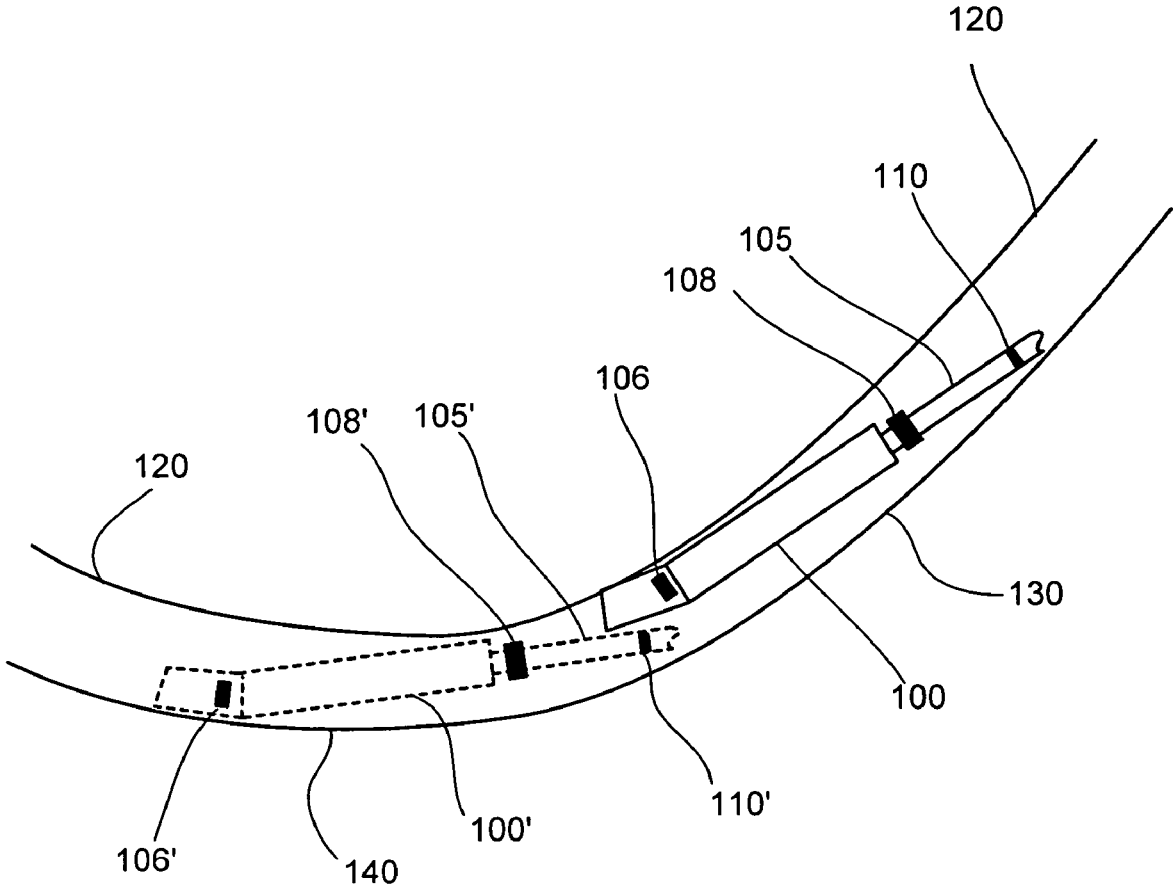
FIG. 1*b* is a diagram of the bottom hole assembly at two points along the borehole according to the teachings of the present invention.
Figure 1C:
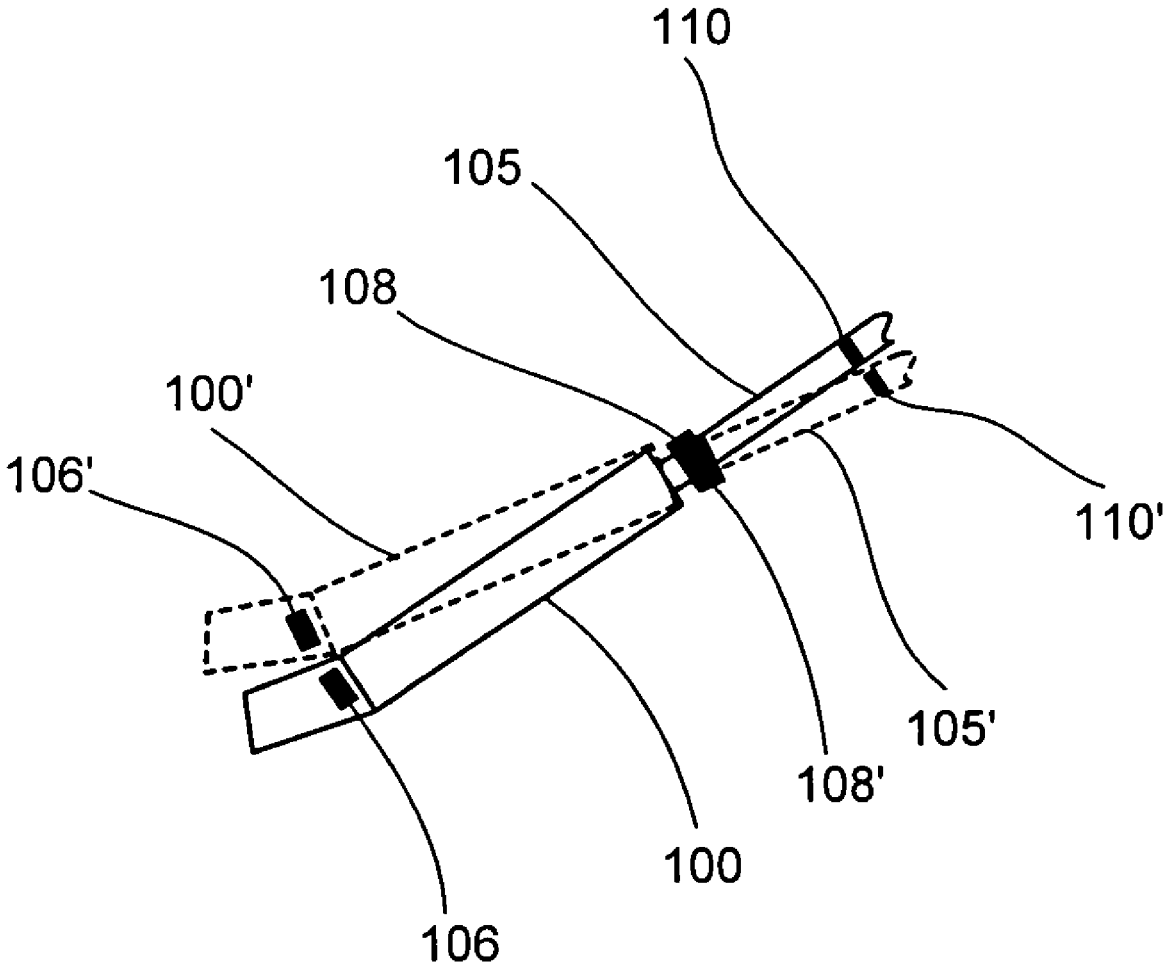
FIG. 1*c* is a diagram illustrating the change in attitude of the bottom hole assembly after encountering a curve in the borehole.

FIG. 1*b* illustrates the BHA 100 at two different positions along the borehole 120. At the initial position 130 (farther up the borehole 120), the BHA 100 has a particular attitude with respect to the Earth. Farther down the borehole at position 140, the attitude is changed because of the curvature of the borehole 120. The absolute position of the BHA 100 with respect to the Earth has changed a negligible amount, but the attitude (amount of rotation about one or more axis with respect to the Earth) of the BHA 100 has changed appreciably because of the curvature of the borehole 120. FIG. 1*c* illustrates the attitude difference by overlaying the BHA 100 at the two different positions 130 (solid line) and 140 (dashed line and prime element numbers). Referring to FIG. 1*c*, and taking sensor 108 as a "pivot point," sensor 106' is "higher" than sensor 106, and sensor 110' is "lower" than sensor 110. In other words, the sensor's attitude between themselves with respect to the Earth is different at different points along the borehole, particularly in curves. The difference in attitude between the sensors 106, 108 and 110 and the fixed reference point (Earth) at various points along the borehole is measurable. Because the attitude difference is measurable, that difference can be used to determine the actual direction of the borehole, and that directional information, in conjunction with the location of the desired destination, can be used to "correct" the subsequent drilling direction of the BHA 100 using the equations identified below. The equations identified below can be implemented on, for example, a digital computer that is incorporated into the system of the present invention in order to make a tangible contribution toward a more useful borehole and/or increase the efficiency of the drilling process.

Distributed acoustic telemetry might be used to determine locations of unintended wall contact, for example, by actively pinging the drill pipe between two sensor locations. Acoustic sensors could also be used for passive listening for washouts in the pipe. A washout can happen anywhere and locating the washout can require slow tripping and careful examination of the drill pipe. Multiple sensors will help locate the washout. Such monitoring could also assist in identification of the location of key seats by monitoring the change in acoustic signature from sensor to sensor. Such analysis might also assist in locating swelling shales to limit requirements for backreaming operations. The availability and analysis of such data would allow for hole conditioning precisely where problem area is located.

Such data might also be useful when not actually drilling, for example in a mode when the drill bit is rotating and off bottom, out of the pilot hole possibly—for example insert and swab or other operations that aren't directly affecting the drilling process. Data might be used to control the rate at which you move the pipe, the trip speed, to make sure you are not surging or swabbing. By having data from multiple sensors, e.g., pressure sensors, some would be swabbing and some would be surging if there is something going on in between them. In addition, high data rate BHA sensors for rotation and vibration might provide information that would mitigate against destructive BHA behaviors.

The Matrix $\tilde{C}$

By its nature, it is not possible to provide an analytical formulation of the matrix $\tilde{C}$ since this must include the unknown and variable magnetic interference to the system. If properly formulated, it is reasonable to assume that $E(v(i))=0\ \forall i$, where E( ) is used to denote expected value. Now consider $$\sum_{i=1}^{n} y(i) = \sum_{i=1}^{n} \tilde{C}(i)\cdot\tilde{x}(i) + \sum_{i=1}^{n} v(i)$$

If we assume that $\tilde{C}(i)$ is approximately constant over the summation interval, and if n is sufficiently large, we can rewrite this as $$\sum_{i=1}^{n} y(i) = \tilde{C}(n)\cdot\sum_{i=1}^{n}\tilde{x}(i) + n\cdot E(v(i)) \text{ or } \sum_{i=1}^{n} y(i) = \tilde{C}(n)\cdot\sum_{i=1}^{n}\tilde{x}(i)$$

There is an implicit assumption here that both the near and far packages have their tool faces aligned in the same direction as the tool face angle selected for the vectors x(i). This detail can be dealt with in the actual programming of a digital computer. Likewise, we will be assuming that there are no cross-axial couplings between any of the sensors. This is a calibration issue, not a signal processing issue.

There should not be any cross-coupling between the near and far instrument packages, or between the inclinometers and magnetometers, so in reality, the equation can be rewritten as two equations of the form $$\sum_{i=1}^{n} y_N(i) = \tilde{C}_N(n)\cdot\sum_{i=1}^{n}\tilde{x}(i) \tag{3}$$

and $$\sum_{i=1}^{n} y_F(i) = C_F(n)\cdot\sum_{i=1}^{n} x(i) \tag{4}$$

where the subscript N refers to measurements made by the instrument package near the bit, and the subscript F refers to measurements made by the instrument package farther from the bit and where the matrix $\tilde{C}_N(n)$ represents the transform from true borehole coordinates to the near sensor package and makes up the first six rows of matrix $\tilde{C}(n)$ and the matrix $C_F(n)$ represents the transform from true borehole coordinates to the far sensor package and makes up the last six rows of the matrix C(n) (note that the added terms from the bias are not included for the far sensor since it is assumed that the far sensor experiences no interference).

Since there should not be any cross-coupling between the inclinometer and the magnetometer packages, the matrix $\tilde{C}_N(n)$ should be sparse and $C_F(n)$ should be block diagonal.

At this point, we must face the practical reality that the x(i) are not known. The following appears to be the only practical way of dealing with this issue, with respect to the determination of $\tilde{C}$. Assume explicitly that the far instrument package reads the true borehole trajectory, at least in the sense that $$\sum_{i=1}^{n} y_F(i) \approx \sum_{i=1}^{n} x(i) \tag{5}$$

This implies that we accept the approximation $C_F \approx I_{6\times6}$ $C_F \approx I_{6\times6}$, where $I_{6\times6}$ is the 6×6 identity matrix. The implications of this will be discussed later, but it will be remarked at this point that although it appears we are obviating the near measurements, this is not quite so, for a further re-ordering of the vectors will be required before the remaining matrices can be determined. One of the biggest issues in formulating this problem has been deriving any useful information from the near survey package. The proposed formulation is capable in principle of using this extra information, although there is certainly some question as to how much true information is added by these sensors. After the discussion of how all matrices and noise processes are estimated has been completed, a summary of all of the relevant steps and assumptions will be made.

We can now write $$\sum_{i=1}^{n} y_N(i) = \tilde{C}_N(n) \cdot \sum_{i=1}^{n} \tilde{y}_F(i) \tag{6}$$

where $\tilde{y}_F$ is an augmented version of $y_F$ that is obtained by adding a seventh element equal to unity.

Other than random noise, which has been averaged out in the vector v(n), the accelerometers in the near package should read the same as the accelerometers in the far package assuming there is no deflection of the BHA section containing both instrument packages. This may not be a valid assumption, but this portion of the BHA should be more rigid than the portion above the far instrument package (if this turns out to be problematic, an iterative approach can be pursued in which the borehole trajectory obtained at each stage of the iteration is used to define a coordinate rotation between the two packages). With this approximation, we obtain the two equations $$\sum_{i=1}^{n} y_{NI}(i) = C_{NI}(n) \cdot \sum_{i=1}^{n} y_{FI}(i) \text{ or } \sum_{i=1}^{n} y_{NI}(i) = \sum_{i=1}^{n} y_{FI}(i)$$

since $C_{NI}=I_{3\times3}$ where $I_{3\times3}$ is the 3×3 identity matrix. Therefore:

$$\sum_{i=1}^{n} y_{NM}(i) = \tilde{C}_{NM}(n) \cdot \sum_{i=1}^{n} \tilde{y}_{FM}(i) \tag{7}$$

In these expressions, the additional subscript I designates inclinometer package, and the additional subscript M designates the magnetometer package. There should be no errors in the inclinometer packages that haven't been taken care of in the calibration, so the augment notation has been dropped for that package and $C_{NI}$ has been set to the 3×3 identity matrix.

Any magnetic materials resident in the drill string near a magnetometer will add an offset to each of the three components. This will appear as a bias. Any magnetic materials housing a magnetometer package will modify the scale factors of the magnetometers within the package. Therefore, the matrix $\tilde{C}_{NM}(n)$ has the following form:

$$\tilde{C}_{NM}(n) = \begin{pmatrix} s_x(n) & 0 & 0 & b_x(n) \\ 0 & s_y(n) & 0 & b_y(n) \\ 0 & 0 & s_z(n) & b_z(n) \end{pmatrix} \tag{8}$$

Two sets of measurements will need to be summed to determine the six coefficients. Alternatively, the coefficients can be determined using the least squares method. The biases are the parameters most likely to change with time, while the scale factors should remain fairly constant and can be determined less frequently. If there are no materials shielding the near magnetometers, the scale factors can be set to the scale factors that were obtained in the calibration of the near magnetometer.

The Noise Processes v(i)

The common assumptions for such processes are that they are stationary, white and uncorrelated. It is doubtful that these assumptions are valid for the system at hand. Because the noise statistics, and possibly even the distribution will vary with lithology, bit type and condition, and weight on bit, the statistics can only be assumed to be quasi stationary. If information on these variables is available, they can also be included in the control variables for the state vector. This should improve system performance. Since the disturbances on most of the sensors will have a common source, it is reasonable to believe they will be correlated. It should be possible to estimate v(i) by examining the data, but it will be necessary to modify the way the data are processed. Because of the way we were forced to define $\tilde{C}(n)$, the true borehole trajectory was assumed to map directly to the far measurements. This causes the system noise to be present in our estimators of the state vectors. The constraint which leads to this, equation (5), also provides the way out of this problem. Equation (5) provides an equality between filtered responses. Hence, we can satisfy Eq. (5) by filtering the outputs of the far sensors. The precise form of the filter can be worked out quite easily once the spatial sampling rate and the spatial resolution desired are known. However, there are some important details:

1. This only makes sense if the power spectrum of the noise peaks at a significantly shorter wavelength than the power spectrum of the borehole trajectory.
2. In order to avoid any lag between the input and output of this filter, it is best to use a symmetrical filter. That is, the x(n) should be estimated from data obtained at equal distances on both sides of point n. In those cases where there are not enough (or no) data points available from the far sensor ahead of point n, then corrected data from the near sensor must be used.

In order to avoid any lag between the input and output of this filter, it is best to use a symmetrical filter. That is, the x(n) should be estimated from data that are obtained at equal distances on both sides of point n. In those cases where there are not enough (or no) data points available from the far sensor ahead of point n, then corrected data from the near sensor must be used.

Generally, a symmetrical weighted sum exponential filter can be used. With such a filter, $$\check{x}(n)_i = \frac{1-\alpha}{1+\alpha\cdot(1-2\cdot\alpha^{\xi})}\cdot\sum_{k=0}^{2-\xi}\alpha^{|k-\xi|}\cdot y(n+\xi-k)_{i+6} \tag{9}$$

For later reference, the transfer function of such a filter is given by:

$$H(\Omega,\alpha,\xi) = \frac{1-\alpha}{1+\alpha\cdot(1-2\cdot\alpha^{\xi})}\cdot\frac{1-\alpha^2-2\cdot\alpha^{\xi+1}\cdot\cos(\Omega\cdot(\xi+1))+2\cdot\alpha^{\xi+2}\cdot\cos(\Omega\cdot\xi)}{1+\alpha^2-2\cdot\alpha\cdot\cos(\Omega)} \tag{10}$$

Where the following notation has been used:

- $\check{x}(n)_i$ is the $i^{th}$ component of an estimator of the $n^{th}$ sample of the state of the system; i=1 . . . 6. A different type of estimator will be defined later with a different notation.
- $\Omega$ is the spatial frequency at which the transfer function is calculated, expressed as a ratio of the physical spatial frequency (samples/unit length) to the spatial sampling frequency in the same units.
- $\alpha$ is a weighting factor, $0<\alpha<1$. Other values can be used, but they will not be useful for the problem at hand. A good initial guess is $\alpha=1/2$.
- $\xi$ is the number of samples included in the filter before and after sample n.

With this transformation, the noise process v(i) can be observed and characterized using:

$$v(n)=y(n)-\tilde{C}(n)\cdot\check{x}(n) \tag{11}$$

By observing successive values of v(n), it is possible to examine the distributions of each of the six processes and estimate their cross-correlations, which will be needed in implementing a Kalman predictor.

The Matrices A and B

The decision whether it makes more sense to use a Kalman type predictor or a brute force least squares approach to the problem at hand is determined mostly by our ability to provide estimators of the matrices A and B. As the solution has been formulated thus far, we already have an estimator of the state x of the system. However, this estimator is simply a low frequency version of the measured response; the underlying physics is not taken into account in any way. The functions of the matrices A and B are to account for the physics governing the bend of the tool and the borehole trajectory and the controls to the system. As the problem has been formulated thus far, there probably isn't enough information to include the physics since the bias and scale factor error in the first six elements of y was derived by assuming that the BHA containing the near and the far elements is rigid compared to the rest of the system. If this assumption is correct, the near and the far sensors provide the same information for any sample i. Can any use be made of the near sensors? It is clear from FIG. 1*c* that the near sensor does provide additional information, and this information can be used by making another modification to the formulation of the state and measurement vectors.

FIG. 1*b* illustrates two successive positions of the BHA. If the borehole is curved, it is evident that, even with ideal sensor packages, the outputs of a sensor package in the near position will differ from those of a far sensor package when measurements are made with each package at the same point in the borehole. By re-ordering the state vector y so that all of the elements refer to a given point in space, it should be possible to make use of this information. A similar re-ordering must be made of the measurement vector, x, but now x must be expanded such that each state vector x(i) has 12 elements: 6 from the near sensor at point i, and 6 from the far sensor as re-mapped. All of the data must be resampled onto a regular grid to allow this to happen. It will be assumed that the resampling noise is small. Any number of readily obtainable resampling algorithms can be used for this purpose. It is best that this be done on a regular grid and that the spacing between the near and far sensors is an integer multiple, M of the spacing between grid elements. Also, the spacing between grid elements should be approximately equal to the average spacing between samples and should by no means be less than this spacing.

As noted earlier, it is not anticipated that the system response will be linear, but it is anticipated that it will be locally linear, i.e., that it will act in a linear fashion from one state to the next. The matrices A(i) and B(i) appropriate for a given x(i) can be obtained by modifying the control variables u(i) and observing the predicted value of x(i+1) over at least as many variations of the control parameters as there are unknowns in the system. Each matrix A(i) has 144 unknowns (it is a 12×12 matrix), while each matrix B(i) has 12c unknowns, where c is the number of control variables (each B(i) is a 12×c matrix). Least squares techniques can be used if the number of variations made in the control parameters is more than the number of unknowns. It is desirable for the matrices A(n) and B(n) to sparse matrices and the number of actual unknowns is considerably less than 12·(12+c). However, this will need to be established either analytically or empirically.

The following criticisms with responses are offered to this technique.

1. It is obvious that we are no longer solving for the borehole trajectory, which was one of the original objectives. In point of fact, no one ever has anything but a model for a borehole trajectory. The information gained with the proposed method should provide the best information to use any of the standard borehole modeling techniques, such as the minimum curvature method. (With the large volume of data available from the drilling system, it may be possible to develop better interpretation methods.)
2. Perhaps a more serious critique is that equations (1) and (2) are treated as uncoupled equations. The reason this can be problematic is that the Kalman predictor makes use of the matrix C. C should also be re-ordered with the re-ordering of the state vector. As a practical matter, this may not be necessary since C is assumed to be quasi-stationary, and hence the submatrices constituting C are quasi-stationary. Nevertheless, a re-ordering of C could be tried in practice to see if any improvement is obtained. It is conceivable that it will be necessary to use $\tilde{C}$ instead of C if the variations in the near magnetometer biases are rapid and related to the system controls. In that case, the x, A, B, D and w will need to be suitably augmented; it is not anticipated that this will add any unknowns to these vectors or matrices.
3. The formulation does not appear to address the real problem at hand, namely the prediction of the state vector from the greatest measured depth within a borehole. The near sensor makes measurements closest to the greatest measured depth, while the far sensor lags (M samples on the resampled grid) behind it. Hence, it would seem that the state space formulation cannot be used when it's really needed due to the lack of knowledge from the far sensor. This is not the case. The partial knowledge from the near sensors can be used with a Kalman predictor to provide estimates of the state at the points where data are missing from the far sensors. These estimates can be used directly as estimates of the readings from the far sensor.

It should be noted that this technique offers a very large advantage: it possible with this formulation to input a proposed set of control variables and examine the resulting state vector using Kalman prediction routines.

Determination of D(n) and w(n)

Unless the specific causes of the noise processes w(n) are known, it is only possible to solve for D(n)·w(n). We in fact don't even know the dimensionality of either term. About all that can be done is to set $D(n)=I_{12\times12}$ and assume that w(n) is a 12×1 column vector. Then the statistics can be enumerated using past data and the equation $$w(n)=x(n+1)-A(n)\cdot x(n)-B(n)\cdot u(n) \tag{12}$$

Summary of Analysis

Each step in the analysis was discussed in fair detail in the preceding sections. In this section, an overview is presented of the analysis. To simplify processing, a few of steps will be presented in a different order from that used above. In addition, the Kalman predictor will be introduced. This was not introduced earlier because no discussion is needed of the predictor once its terms have been defined.

Figure 2:
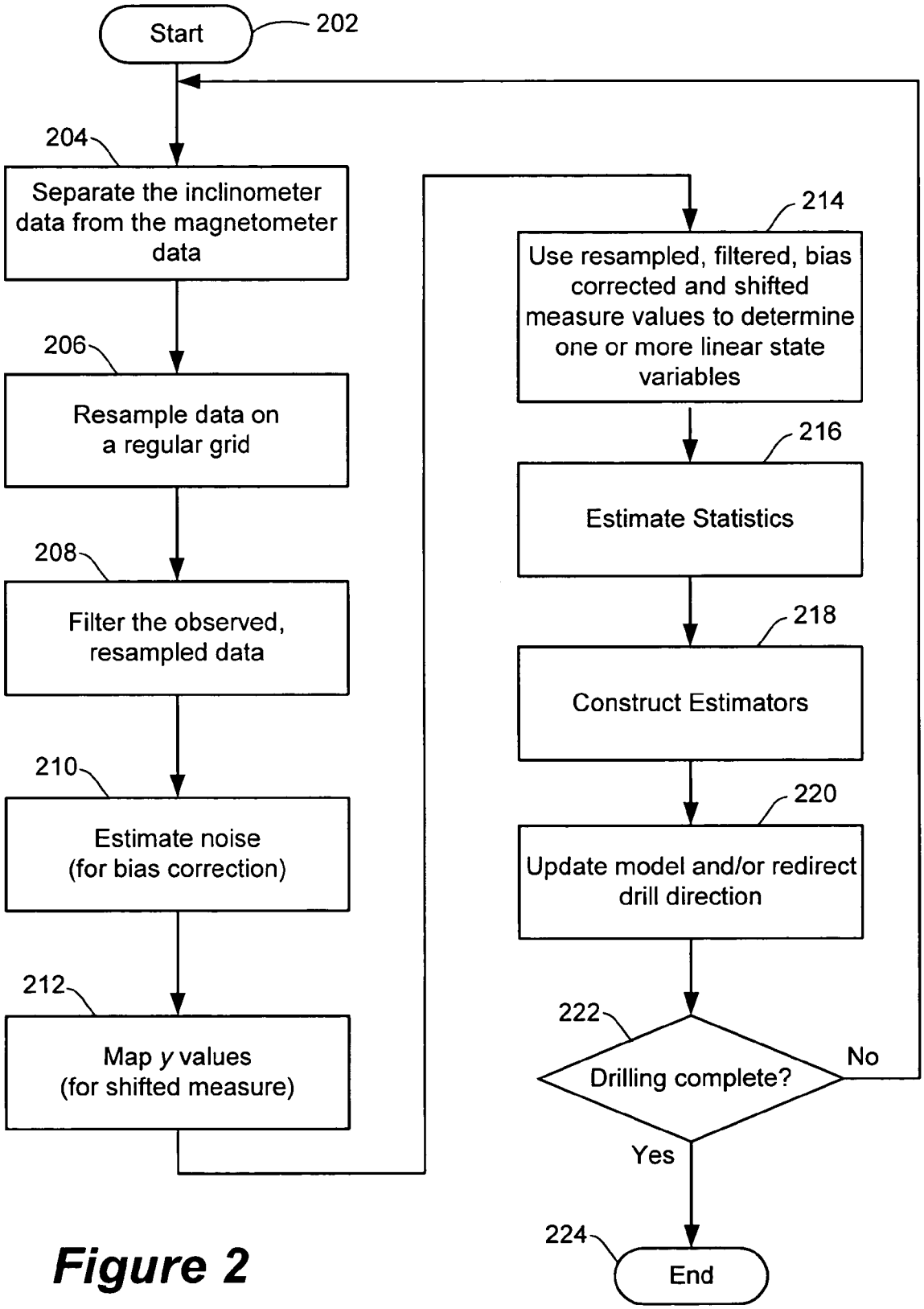
FIG. 2 is a flowchart of the method the present invention.

Reference is made to FIG. 2, which illustrates the overall method of the invention. The method 200 begins generally at step 202. In step 204, the inclinometer data is separated from the magnetometer data. To do so, one begins with the series $$y_N(i) \text{ and } y_F(i), \text{ for } i=0 \ldots n$$

where n designates the latest available sample. There are the near (sensor 108 of FIG. 1) and far (sensor 110) inc/mag readings, respectively. The inclinometer data and the magnetometer data are then separated by constructing $y_{FM}(i)$ as the argument set of vectors of the far magnetometer readings. Using equations (7) and (8) (defined above), and the method of least squares, one can determine $\tilde{C}_{NM}(i)$ and from that, construct $\tilde{C}(i)$ and C(i).

In step 206, the data is resampled on a regular grid. This step is performed with M samples between the near and the far sensor packages.

In step 208, the observed, resampled data is filtered. Specifically, the variables α and ξ are specified. The observed/resampled data are then spacially filtered by calculating $\check{x}(i)_j$ using equation (9).

The amount of noise is estimated in step 210 in order to allow for bias correction. To estimate the statistics of the noise w(i), noting that $D(i)=I_{6\times6}$, one would use equation (12) to determine the values of w(i). Then the value of E(w(i)) and E(w(i)·w(j)) are determined.

In step 212, the y values are mapped for shifted measure. Specifically, y values are mapped such that each far measurement references the same point in space as each near measurement. This involves shifting the far measurements by M samples:

$$y_{Far\ re\text{-}mapped}(i)=y_{Far}(i+M),\ i=1 \ldots n-M$$

where n is the index of the last available data value.

The resulting data (which has been resampled, filtered, bias corrected and shifted measure) is then used to determine the direction of subsequent drilling of the BHA 100 in step 214. Specifically, one uses (in the form as x(i), i=1 . . . n−M) the resampled, filtered, bias corrected and shifted measured values. Thereafter, A and B (matrices of the linear state variables) are determined using equation (1) and the method of least squares. The input control variables u(i) from each of the measurements can be used as input values.

In step 216, the statistics of v(i) are estimated using equation (11). Specifically, E(v(n)), E(v(n)·v(m)) are estimated.

The estimators are constructed in step 218. As in step 214, the input control variables u(i) from each of the measurements can be used as input values. In step 218, the estimators of the states n−M+1 . . . n are constructed by recursively applying the following equations:

$$\hat{x}(i+1)=[A(i)-K(i)\cdot C(i)]\cdot\hat{x}(i)+B(i)\cdot u(i)+K(i)\cdot y(i) \tag{13}$$

(use $\tilde{y}(i)$ when y(i) is not available)

$$\hat{y}(i)=C(i)\cdot\hat{x}(i) \tag{14}$$

$$K(i)=A(i)\cdot P(i)\cdot C^T(i)\cdot[C(i)\cdot P(i)C^T(i)+R_v(i)]^{-1} \tag{15}$$

$$P(i)=[A(i)-K(i)\cdot C(i)]\cdot P(i)\cdot[A(i)-K(i)\cdot C(i)]^T+R_w(i)+K(i)\cdot R_v(i)\cdot K(i)^T \tag{16}$$

$$P(0)=Cov(x(0),x(0)) \tag{17}$$

which are used to determine $\hat{x}$. In these expressions, $R_v(i)$ is the correlation matrix of the vector v(i), and $R_w(i)$ is the correlation matrix of the vector w(i) estimated from their statistics. These are assumed to be quasi-stationary and diagonal. As noted earlier, it is unlikely that true diagonality will be achieved. It is suggested that the Kalman algorithm be tried with the covariances as estimated with no attempt at diagonalization.

Once the missing information due to the lag of the far sensors has been estimated using the recursion discussed above, equations (13)–(17) can again be applied recursively from any end point to project the behavior of the system as a function of the control variables. The only difference is that, in this case, the values of y are also projected using the Kalman equations.

While the above method has been given as a series of discrete steps, it will be understood that the steps illustrated above are but one example of the method of the present invention, and that variations of the method, such as reordering steps and/or the substitution of one or more equations are possible without departing from the spirit and scope of the invention.

If it is desirable at that point along the borehole, the results of the above computations can be used, in step 220, to revise the drilling direction. In other words, the information gathered along the drill string can be used to modify the drilling vector and/or be used to modify the current model that is used to direct the drilling activity (to form an updated model). As mentioned before, the modification of the drilling model can occur continuously, or at discrete intervals along the borehole (based on time and/or distance).

A check is made at step 222 to determine if the drilling (and thus the borehole) is complete. If so, the method ends generally at step 222. Otherwise, the method reverts back to step 204 and the method resumes. While this process can be repeated continually along the borehole, it is better to make course corrections at discrete intervals along the borehole. While making course corrections only at discrete intervals may lead to a longer drill string, there are benefits to avoiding continuous course correction. For instance, discrete course corrections oftentimes leads to less "kinky" boreholes that are easier to use once drilled. Moreover, the drilling efficiency between the discrete course corrections can be significantly higher than with drill strings that are continuously corrected. See, e.g., "Toruosity versus Micro-Tortuosity—Why Little Things Mean a Lot" by Tom Gaynor, et al., SPE/IADC 67818 (2001).

The above method, and alternate embodiments thereof, can be implemented as a set of instructions on, for example, a general purpose computer. General purpose computers include, among other things, digital computers having, for example, one or more central processing units. The central processing units can be in a personal computer, or micro-controllers embedded within the BHP, or some other device or combination of devices. The general purpose computers used to implement the method of the present invention can be fitted into or connected with any number of devices (for decentralized computing) and can be networked, be placed on a grid, or perform the calculations in a stand-alone fashion. The computer used for implementing the method of the present invention can be fitted with display screens for output to a user, and/or can be connected directly to control units that control the character and manner of drilling. Moreover, the computer system that implements the method of the present invention can include input devices that enable a user to impart instructions, data, or commands to the implementing device in order to control or to otherwise utilize the information and control capability possible with the present invention. The computer system that implements the present invention can also be fitted with system memory, persistent storage capacity, or any other device or peripheral that can be connected to the central processing unit and/or a network to which the computer system operates. Finally, the method of the present invention can be implemented in software, in hardware, or any combination of hardware and software. The software can be stored upon a machine-readable storage medium, such as a compact disk ("CD"), floppy disk, digital versatile disk ("DVD"), memory stick, etc.

Figure 3:
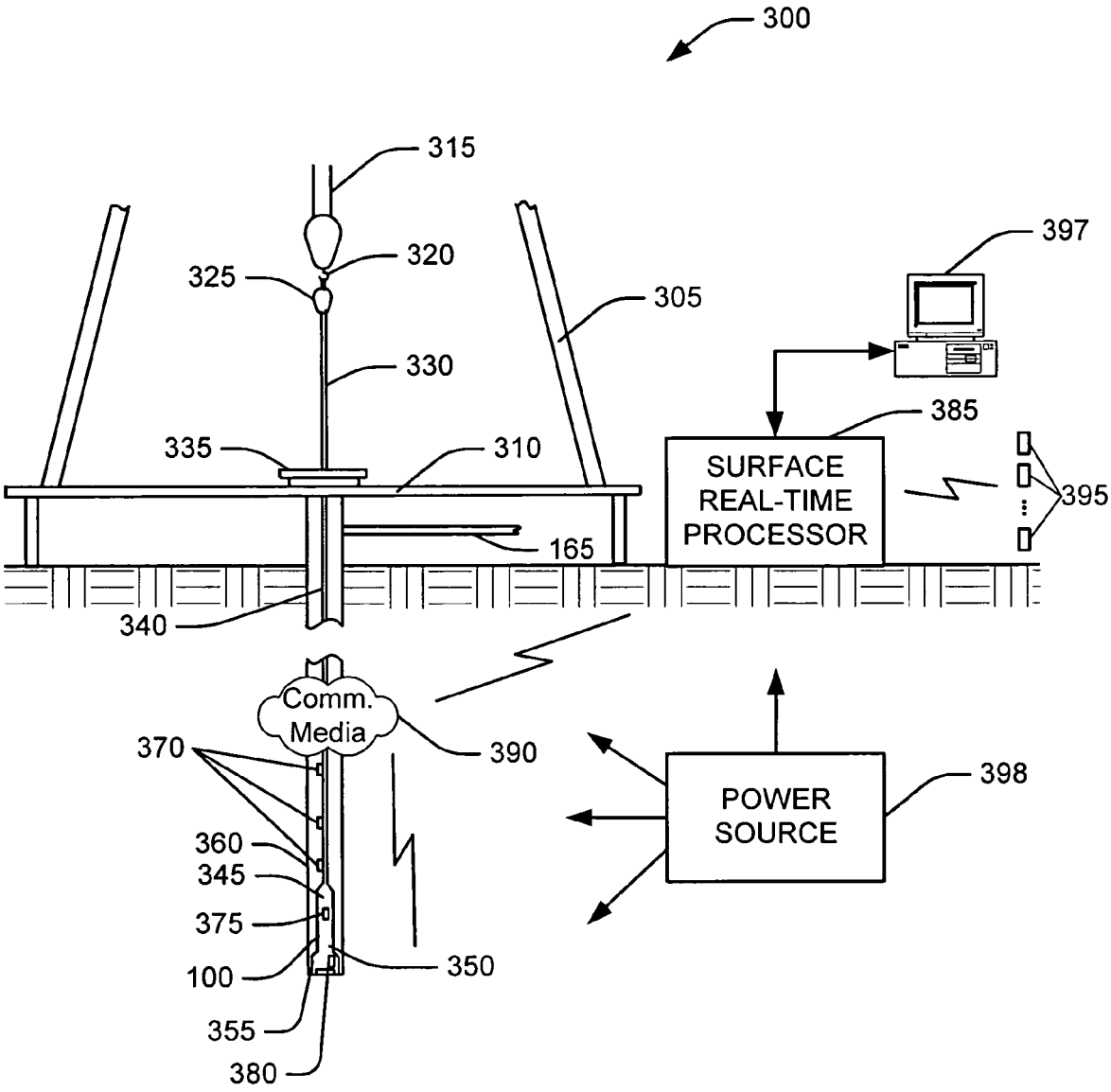
FIG. 3 shows a system for surface real-time processing of downhole data.

The method of the present invention can be implemented on the system illustrated in FIG. 3. The oil well drilling equipment 300 (simplified for ease of understanding) includes a derrick 305, derrick floor 310, draw works 315 (schematically represented by the drilling line and the traveling block), hook 320, swivel 325, kelly joint 330, rotary table 335, drill string 340, drill collar 345, LWD tool or tools 350, and drill bit 355. Mud is injected into the swivel by a mud supply line (not shown). The mud travels through the kelly joint 330, drill string 340, drill collars 345, and LWD tool(s) 350, and exits through jets or nozzles in the drill bit 355. The mud then flows up the annulus between the drill string and the wall of the borehole 360. A mud return line 365 returns mud from the borehole 360 and circulates it to a mud pit (not shown) and back to the mud supply line (not shown). The combination of the drill collar 345, LWD tool(s) 350, and drill bit 355 is known as the bottom hole assembly (or "BHA") 100 (see FIG. 1*a*).

A number of downhole sensor modules and downhole controllable elements modules 370 are distributed along the drill string 340, with the distribution depending on the type of sensor or type of downhole controllable element. Other downhole sensor modules and downhole controllable element modules 375 are located in the drill collar 345 or the LWD tools. Still other downhole sensor modules and downhole controllable element modules 380 are located in the bit 380. The downhole sensors incorporated in the downhole sensor modules, as discussed below, include acoustic sensors, magnetic sensors, calipers, electrodes, gamma ray detectors, density sensors, neutron sensors, dipmeters, imaging sensors, and other sensors useful in well logging and well drilling. The downhole controllable elements incorporated in the downhole controllable element modules, as discussed below, include transducers, such as acoustic transducers, or other forms of transmitters, such as gamma ray sources and neutron sources, and actuators, such as valves, ports, brakes, clutches, thrusters, bumper subs, extendable stabilizers, extendable rollers, extendible feet, etc.

The sensor modules and downhole controllable element modules communicate with a surface real-time processor 385 through communications media 390. The communications media can be a wire, a cable, a waveguide, a fiber, or any other media that allows high data rates. Communications over the communications media 390 can be in the form of network communications, using, for example Ethernet, with each of the sensor modules and downhole controllable element modules being addressable individually or in groups. Alternatively, communications can be point-to-point. Whatever form it takes, the communications media 390 provides high speed data communication between the devices in the borehole 360 and the surface real-time processor.

The surface real-time processor 385 also has data communication, via communications media 390 or another route, with surface sensor modules and surface controllable element modules 395. The surface sensors, which are incorporated in the surface sensor modules as discussed below, include, for example, weight-on-bit sensors and rotation speed sensors. The surface controllable elements, which are incorporated in the surface controllable element modules, as discussed below, include, for example, controls for the draw works 315 and the rotary table 335.

The surface real-time processor 385 also includes a terminal 397, which may have capabilities ranging from those of a dumb terminal to those of a workstation. The terminal 397 allows a user to interact with the surface real-time processor 385. The terminal 397 may be local to the surface real-time processor 385 or it may be remotely located and in communication with the surface real-time processor 385 via telephone, a cellular network, a satellite, the Internet, another network, or any combination of these.

Figure 4:
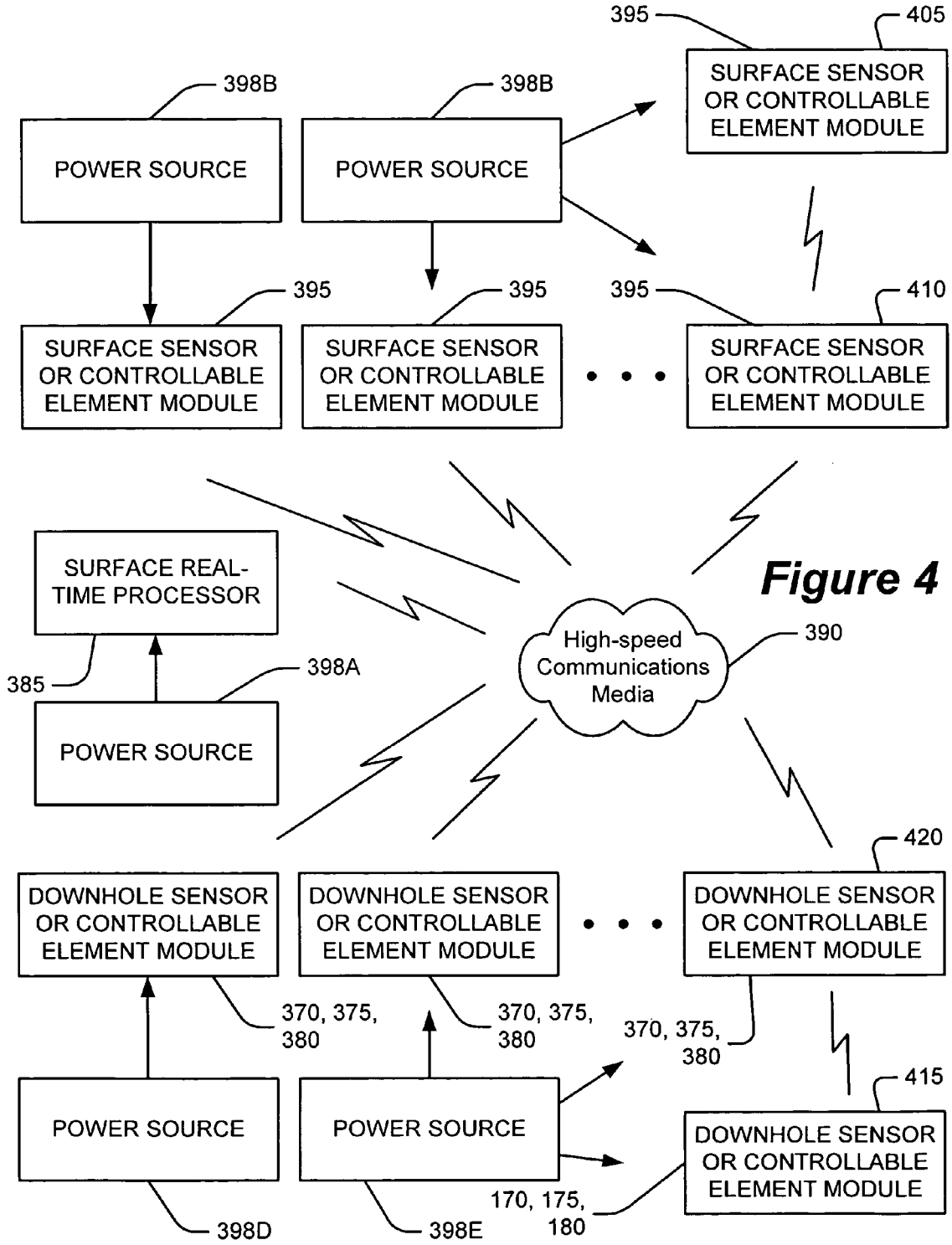
FIG. 4 shows a logical representation of a system for surface real-time processing of downhole data.

As illustrated by the logical schematic of the system in FIG. 4, the communications media 390 provides high speed communications between the surface sensors and controllable elements 395, the downhole sensor modules and controllable element modules 370, 375, 380, and the surface real-time processor 385. In some cases, the communications from one downhole sensor module or controllable element module 405 may be relayed through another downhole sensor module or downhole controllable element module 410. The link between the two downhole sensor modules or downhole controllable element modules 405 and 410 may be part of the communications media 390. Similarly, communications from one surface sensor module or surface controllable element module 415 may be relayed through another downhole sensor module or downhole controllable element module 420. The link between the two downhole sensor modules or downhole controllable element modules 415 and 420 may be part of the communications media 390.

The communications media 390 may be a single communications path or it may be more than one. For example, one communications path, e.g. cabling, may connect the surface sensors and controllable elements 395 to the surface real-time processor 385. Another, e.g. wired pipe, may connect the downhole sensors and controllable elements 395 to the surface real-time processor 385.

The communications media 390 is labeled "high speed" on FIG. 4. This designation indicates that the communications media 390 operates at a speed sufficient to allow real-time control, through the surface real time processor 385, of the surface controllable elements and the downhole controllable elements based on signals from the surface sensors and the surface controllable elements. Generally, the high speed communications media 390 provides communications at a rate greater than that provided by mud telemetry. In some example systems, the high speed communications are provided by wired pipe, which at the time of filing was capable of transmitting data at a rate of approximately 1 megabit/second. Considerably higher data rates are expected in the future and fall within the scope of this disclosure and the appended claims.

Figure 5:
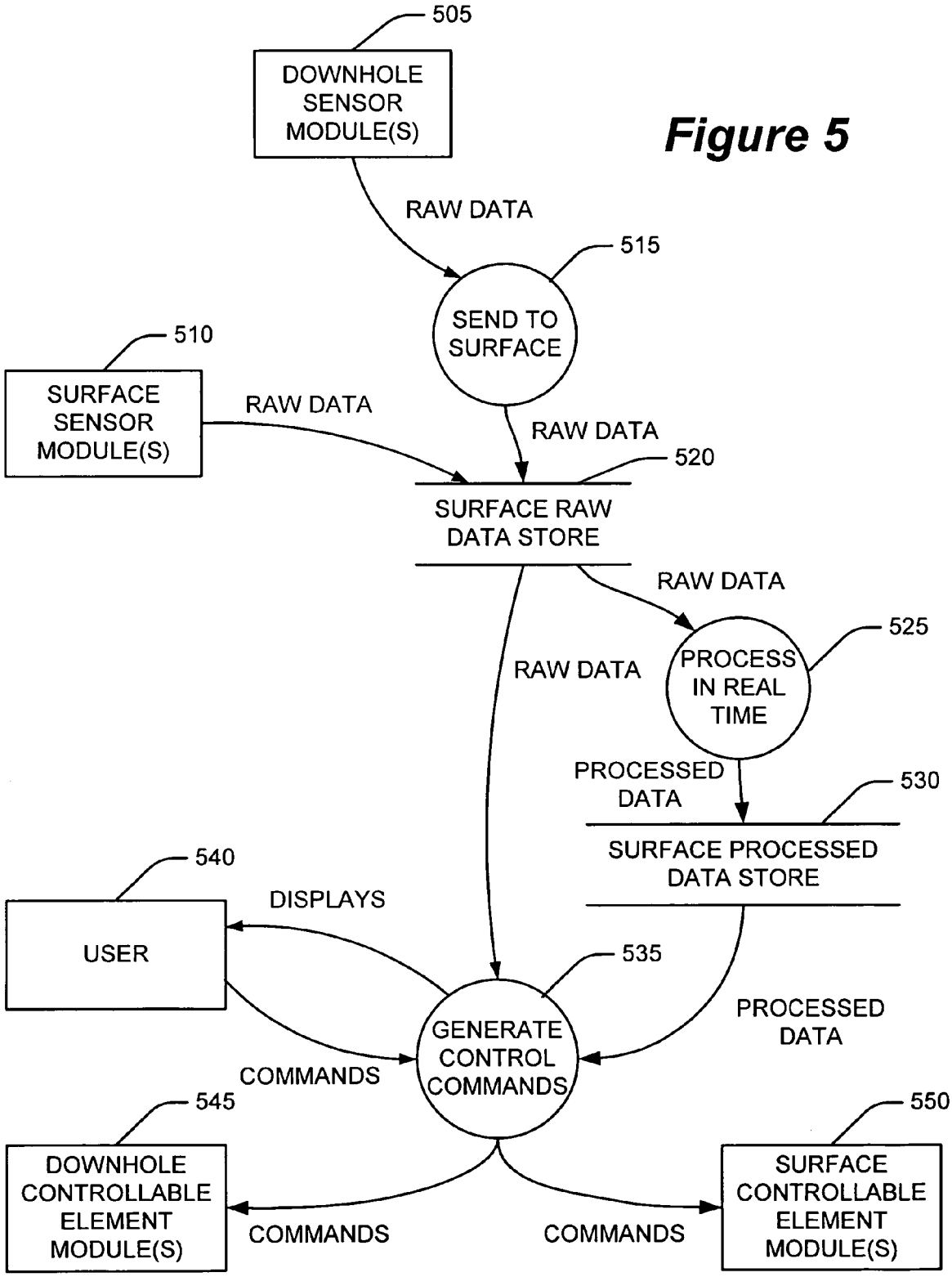
FIG. 5 shows a data flow diagram for a system for surface real-time processing of downhole data.

A general system for real-time control of downhole and surface logging while drilling operations using data collected from downhole sensors and surface sensors, illustrated in FIG. 5, includes downhole sensor module(s) 505 and surface sensor module(s) 510. Raw data is collected from the downhole sensor module(s) 505 and sent to the surface (block 515) where it is stored in a surface raw data store 520. Similarly, raw data is collected from the surface sensor module(s) 510 and stored in the surface raw data store 520.

Raw data from the surface raw data store 520 is then processed in real time (block 525) and the processed data is stored in a surface processed data store 530. The processed data is used to generate control commands (block 535). In some cases, the system provides displays to a user 540 through, for example, terminal 397, who can influence the generation of the control commands. The control commands are used to control downhole controllable elements 545 and surface controllable elements 550.

In many cases, the control commands produce changes or otherwise influence what is detected by the downhole sensors and the surface sensors, and consequently the signals that they produce. This control loop from the sensors through the real-time processor to the controllable elements and back to the sensors allows intelligent control of logging while drilling operations. In many cases, as described below, proper operation of the control loops requires a high speed communication media and a real-time surface processor.

Generally, the high-speed communications media 390 permits data to be transmitted to the surface where it can be processed by the surface real-time processor 385. The surface real-time processor 385, in turn, may produce commands that can be transmitted to the downhole sensors and downhole controllable elements to affect the operation of the drilling equipment.

Moving the processing to the surface and eliminating much, if not all, of the downhole processing makes it possible in some cases to reduce the diameter of the drill string producing a smaller diameter well bore than would otherwise be reasonable. This allows a given suite of downhole sensors (and their associated tools or other vehicles) to be used in a wider variety of applications and markets.

Further, locating much, if not all, of the processing at the surface reduces the number of temperature-sensitive components that must operate in the severe environment encountered as a well is being drilled. Few components are available which operate at high temperatures (above about 200° C.) and design and testing of these components is very expensive. Hence, it is desirable to use as few high temperature components as possible.

Further, locating much, if not all, of the processing at the surface improves the reliability of the downhole design because there are fewer downhole parts. Further, such designs allow a few common elements to be incorporated in an array of sensors. This higher volume use of a few components results in a cost reduction in these components.

Figure 6:
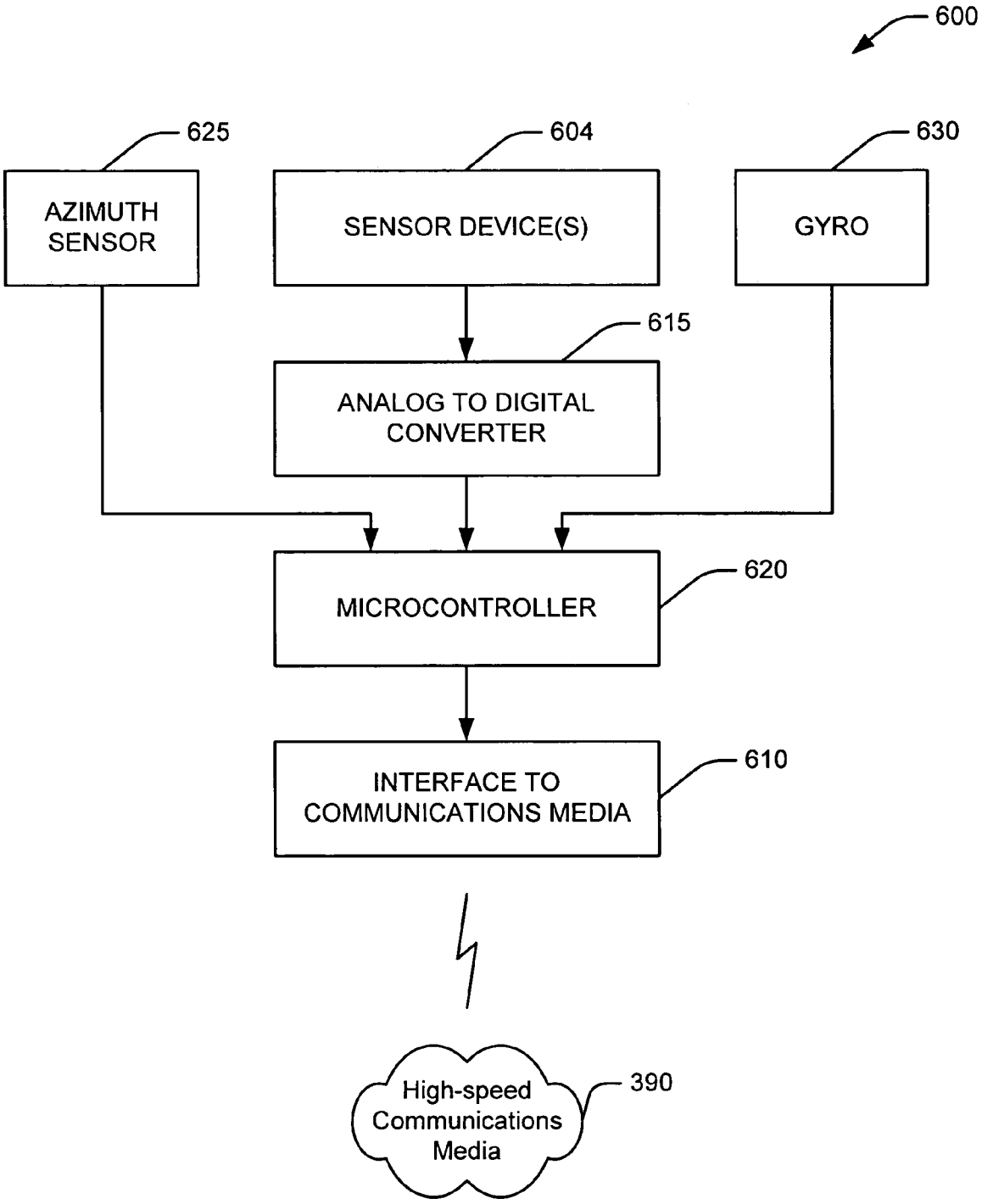
FIG. 6 shows a block diagram for a sensor module.
Figure 7:
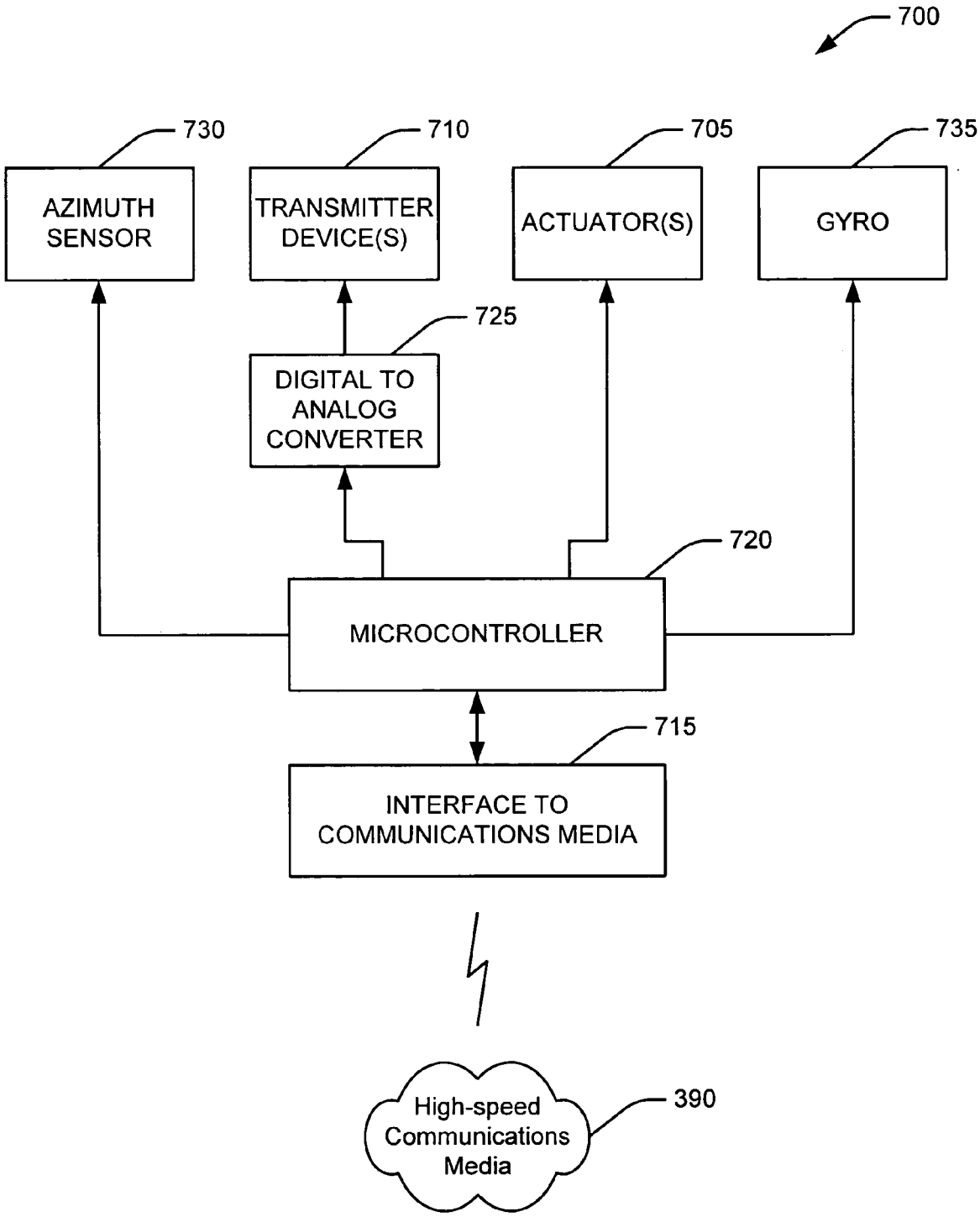
FIG. 7 shows a block diagram for a controllable element module.

An example sensor module 600, illustrated in FIG. 6, includes, at a minimum, a sensor device or devices 605 and an interface to the communications medium 610 (which is described in more detail with respect to FIGS. 6 and 7). In most cases, the output of each sensor device 605 is an analog signal and generally the interface to the communications media 610 is digital. An analog to digital converter (ADC) 615 is provided to make that conversion. If the sensor device 605 produces a digital output or if the interface to the communications media 610 can communicate an analog signal through the communications media 390, the ADC 615 is not necessary.

A microcontroller 620 may also be included. If it is included, the microcontroller 620 manages some or all of the other devices in the example sensor module 600. For example, if the sensor device 605 has one or more controllable parameters, such as frequency response or sensitivity, the microcontroller 620 may be programmed to control those parameters. The control may be independent, based on programming included in memory attached to the microcontroller 620, or the control may be provided remotely through the high-speed communications media 390 and the interface to the communications media 610. Alternatively, if a microcontroller 620 is not present, the same types of controls may be provided through the high-speed communications media 390 and the interface to communications media 610.

The sensor module 600 may also include an azimuth sensor 625, which produces an output related to the azimuthal orientation of the sensor module 600, which is itself related to the orientation of the drill string because the sensor modules are coupled to the drill string. Data from the azimuth sensor 625 is compiled by the microcontroller 620, if one is present, and sent to the surface through the interface to the communications media 610 and the high-speed communications media 390. Data from the azimuth sensor 625 may need to be digitized before it can be presented to the microcontroller 620. If so, one or more additional ADCs (not shown) would be included for that purpose. At the surface, the surface processor 385 combines the azimuthal information with other information related to the depth of the sensor module 600 to identify the location of the sensor module 600 in the earth. As that information is compiled, the surface processor (or some other processor) can compile a good map of the borehole.

The sensor module 600 may also include a gyroscope 630, which provides orientation information in three axes rather than just the single axis information provided by the azimuth sensor 625. The information from the gyroscope is handled in the same manner as the azimuthal information from the azimuth sensor, as described above.

An example controllable element module 700, shown in FIG. 7, includes, at a minimum, an actuator 705 and/or a transmitter device or devices 710 and an interface to the communications media 715. The actuator 705 is one of the actuators described above and may be activated through application of a signal from, for example, a microcontroller 720, which is similar in function to the microcontroller 620 shown in FIG. 6. The transmitter device is a device that transmits a form of energy in response to the application of an analog signal. An example of a transmitter device is an piezoelectric acoustic transmitter that converts an analog electric signal into acoustic energy by deforming a piezoelectric crystal. In the example controllable element module 700 illustrated in FIG. 7, the microcontroller 720 generates the signal that is to drive the transmitter device 710. Generally, the microcontroller generates a digital signal and the transmitter device is driven by an analog signal. In those instances, a digital-to-analog converter ("DAC") 725 is necessary to convert the digital signal output of the microcontroller 720 to the analog signal to drive the transmitter device 710.

The example controllable element module 700 may include an azimuth sensor 730 or a gyroscope 735, which are similar to those described above in the description of the sensor module 600.

The interface to the communications media 615, 715 can take a variety of forms. In general, the interface to the communications media 615, 715 is a simple communication device and protocol built from, for example, (a) discrete components with high temperature tolerances or (b) from programmable logic devices ("PLDs") with high temperature tolerances.

The above-described computer system can be used in conjunction with the method of the present invention. The method of the present invention can be reduced to a set of instructions that can run on a general purpose computer, such as computer 397. The set of instructions can comprise an input routine that can be operatively associated with one or more sensors along the drill string and/or the BHP. Similarly, the input routine can accept instructions from a user via one or more input devices, such as a keyboard, mouse, trackball, or other input device. The set of instructions can also include a run routine that implements the method of the present invention or any part thereof to generate, for example, an updated model. The set of instructions can include an output routine that displays information, such as the results of the method of the present invention, to a user, such as through a monitor, printer, generated electronic file, or other device. Similarly, the output routine can be operatively associated with control elements of the drill string and other drilling equipment in order to direct the drilling operation or any portion thereof.

The foregoing description of the embodiments of the invention has been presented for the purposes of illustration and description. The foregoing description is not intended to be exhaustive, or to limit the invention to the precise form disclosed. Many modifications and variations are possible in light of the above teaching. It is intended that the scope of the invention be limited not by this detailed description, but rather by the claims appended hereto.

The invention claimed is:

1. A method of drilling a borehole, comprising:
providing a model;
drilling a discrete interval of a borehole based upon the model; and
modifying the model based on data obtained during drilling, where modifying the model based on data obtained during drilling comprises separating inclinometer data from magnetometer data.

2. The method of claim 1, wherein the model is the drill string whirl model.

3. The method of claim 1, wherein the model is the torque/drag/bucking model.

4. The method of claim 1, wherein the model is the BHA dynamics model.

5. The method of claim 1, wherein the model is the geosteering model.

6. The method of claim 1, wherein the model is the hydraulics model.

7. The method of claim 1, wherein the model is the geomechanics model.

8. The method of claim 1, wherein the model is the pore pressure/fracture gradient model.

9. The method of claim 1, wherein the model is the SFIP model.

10. The method of claim 1, wherein the step of modifying comprises:
resampling data on a regular grid.

11. The method of claim 1, wherein the step of modifying comprises:
filtering observed data.

12. The method of claim 1, wherein the step of modifying comprises:
estimating noise.

13. The method of claim 1, wherein the step of modifying comprises:
mapping y values.

14. The method of claim 1, wherein the step of modifying comprises:
determining one or more linear state variables.

15. The method of claim 1, wherein the step of modifying comprises:
estimating statistics.

16. The method of claim 1, wherein the step of modifying comprises:
constructing estimators.

17. A method of drilling a borehole, comprising:
providing a model;
drilling a discrete interval of a borehole based upon the model;
modifying the model based on data obtained during drilling by:
separating the inclinometer data from the magnetometer data;
resampling data on a regular grid;
filtering observed data;
estimating noise;
mapping y values;
determining one or more linear state variables;
estimating statistics; and
constructing estimators.

18. The method of claim 17, wherein the model is the drill string whirl model.

19. The method of claim 17, wherein the model is the torque/drag/bucking model.

20. The method of claim 17, wherein the model is the BHA dynamics model.

21. The method of claim 17, wherein the model is the geosteering model.

22. The method of claim 17, wherein the model is the hydraulics model.

23. The method of claim 17, wherein the model is the geomechanics model.

24. The method of claim 17, wherein the model is the pore pressure/fracture gradient model.

25. The method of claim 17, wherein the model is the SFIP model.

26. A computer-readable storage medium containing a set of instructions for a general purpose computer, the set of instructions comprising:
an input routine operatively associated with one or more sensors;

a run routine for implementing an update method, wherein the run routine is constructed and arranged to separate the inclinometer data from the magnetometer data; and an output routine for controlling a drilling operation.

27. The storage medium of claim 26, wherein the run routine is constructed and arranged to:

resample data on a regular grid;

filter observed data;

estimate noise;

map y values;

determine one or more linear state variables;

estimate statistics; and construct estimators.

* * * * *